US006603711B2

(12) United States Patent
Calace

(10) Patent No.: US 6,603,711 B2
(45) Date of Patent: Aug. 5, 2003

(54) REMOTE TIMEKEEPING DEVICE AND SYSTEM FOR CONTROLLING SPORTS CLOCK

(76) Inventor: Michael A. Calace, 1200 McGill College Avenue, #1100, Montreal, Quebec (CA), H3B 4G7

( * ) Notice: Subject to any disclaimer, the term of this patent is extended or adjusted under 35 U.S.C. 154(b) by 0 days.

(21) Appl. No.: 09/960,357

(22) Filed: Sep. 24, 2001

(65) Prior Publication Data

US 2003/0058744 A1 Mar. 27, 2003

(51) Int. Cl.[7] ..... G04F 10/00; G04C 11/02; G04B 47/00

(52) U.S. Cl. ..... 368/109; 368/10; 368/47

(58) Field of Search ..... 368/10, 47, 107–113

(56) References Cited

U.S. PATENT DOCUMENTS 3,651,507 A * 3/1972 Abbott ..... 340/309.4
3,739,368 A 6/1973 Stalp
4,281,389 A * 7/1981 Smith ..... 2/160
4,526,479 A * 7/1985 Harris ..... 340/309.15
4,652,141 A * 3/1987 Arai ..... 368/10
4,681,462 A * 7/1987 Lloyd ..... 224/164
5,293,354 A 3/1994 Costabile
5,381,389 A 1/1995 Shimbo
5,511,045 A * 4/1996 Sasaki et al. ..... 340/323 R
5,745,439 A * 4/1998 Nepple ..... 368/10
6,144,620 A * 11/2000 dePoortere ..... 368/108
6,154,199 A * 11/2000 Butler ..... 345/158
6,181,236 B1 * 1/2001 Schneider, Jr. ..... 340/323 R
6,299,345 B1 * 10/2001 Burnette ..... 273/237
6,331,965 B1 * 12/2001 Sato et al. ..... 368/10
6,369,697 B1 * 4/2002 Poole ..... 340/309.15
6,392,962 B1 * 5/2002 Wyatt ..... 368/107

* cited by examiner

*Primary Examiner*—David Martin
*Assistant Examiner*—Michael L. Lindinger
(74) *Attorney, Agent, or Firm*—Peter A. Borsari

(57) ABSTRACT

A timekeeping system comprising one or more portable timekeeping devices, each portable timekeeping device being configured to start, stop and otherwise control a remote timer adapted to maintain an official time and optionally at least one other time, such as a game clock. Each portable timekeeping device includes a wireless transmitter and a triggering member, activation of the triggering member actuates a wireless signal which is sent to the remote timer in order to stop the official time. The timekeeping system also can include two-way communication between the remote timer and each portable timekeeping device. The two-way communication enables the official time and any other times being maintained by the remote timer to be displayed on each portable device. The portable timekeeping device and system is designed primarily for use with sporting events, particularly, but not limited to, hockey, football and basketball.

28 Claims, 4 Drawing Sheets

REMOTE TIMEKEEPING DEVICE AND SYSTEM FOR CONTROLLING SPORTS CLOCK

FIELD OF INVENTION

The present invention relates to a portable timekeeping device which can start, stop, maintain and otherwise control a remote timer adapted to maintain an official time and optionally, at least one other time. The present invention also relates to a timekeeping system comprising one or more portable timekeeping devices each of which is capable of controlling a remote timer adapted to maintain an official time and optionally, at least one other time. More particularly, the portable timekeeping device and system is designed primarily for use with sporting events, particularly, but not limited to, hockey, football and basketball.

BACKGROUND OF THE INVENTION

Many sport games played today are timed events in which competing teams attempt to obtain the most points during a specified period, referred to as the official time. The official time, maintained on a timekeeping board and/or a game clock, often is stopped and re-started due to several factors, including called time-outs and called penalties. The stopping and re-starting of the official time leads to time keeping inaccuracies in the official time, the most notable of which is loss of "game time". Loss of game time results from the time delay between when a time-out or penalty is called, usually by an individual officiating the game, and the actual stopping of the official time on a game clock. The loss of game time can be a significant factor in the outcome of the game.

A typical National Hockey League (NHL) game can be used to illustrate loss of "game time". The official time of play for an NHL game is sixty (60) minutes. However, on average, the game is played only for about fifty-seven (57) minutes. The three (3) minute difference between the official time and the actual time of play is the loss of "game time". This three-minute loss of game time primarily is due to the fact that there is a time delay from the moment when the individual officiating the game signals to the game clock timekeeper that the official time should be stopped and the time when the game clock actually is stopped. There are several causes contributing to this time delay, including (1) the time required for the officiating individual to bring his arm to his face, whistle to his mouth and then exert a breath to blow the whistle signaling that the game clock should be stopped, (2) the time required for the sound of the signal to travel from the whistle and across the sporting venue to the official timekeeper, (3) the reaction time of the official timekeeper to receive the signal and physically stop the game clock and (4) the time from when the hockey puck is dropped onto the ice to resume play and when the game clock is re-started.

Attempts have been made in the prior art to provide an official with means to automatically control a timer. For example, U.S. Pat. No. 5,381,389 to Shimbo, issued Jan. 10, 1995 and U.S. Pat. No. 3,739,368 to Stalp, issued Jun. 12, 1973, disclose timekeeping systems in which a start signal is triggered by a start pistol which emits an audible signal and simultaneously starts a clock connected thereto by a transmission cable. An inherent disadvantage of these systems is the use of cable, rather than wireless communication. As described, such a system could not be utilized in a sporting event in which the one or more officials are situated on the area of play. In addition, these systems only provides means to start a clock, not for stopping a clock.

U.S. Pat. No. 5,293,354 to Costabile, issued Mar. 8, 1994, discloses a remotely actuable sports timing system that automatically responds to a whistle blown by a sports official to generate a radio signal which provides an instantaneous switching signal to actuate a game clock. Specifically, each individual officiating a game carries an actuating system including a whistle to be gripped between the teeth, a microphone in close proximity of the whistle and connected to a radio transmitter which is clipped to the official's belt or clothing. In practice, when the individual blows the whistle, the emitted sound therefrom is amplified by the microphone and causes a first radio control signal to be sent from the radio transmitter to a radio receiver which receives the first radio control signal and generates a remote switching signal in response to the radio control signal. The remote switching signal is connected to a controller having switching means to actuate the game clock. The radio transmitter also may be provided with one or more push buttons, each of which can generate a second radio control signal oscillating at a different frequency than the first radio control signal, the second radio control signal also being sent to the radio receiver and converted to a remote switching signal for actuating a timer.

The system provided by Costabile has several drawbacks. First, the requirement that each official carry three items, namely the whistle, microphone and radio transmitter, is cumbersome and creates an unnecessary burden on each official. Second, the system is overly complicated and confusing in that two separate and distinct radio signals can be generated and transmitted at different frequencies by the radio transmitter depending on the action of the official; each signal requiring a different action by the radio receiver. Third, the official's unit does not display the official time or any other game time.

Despite the attempts of the prior art, a need still exists for a timekeeping device and system comprising a portable timekeeping device which can remotely start, stop, maintain and otherwise control a remote timer, such as a game clock, which maintains an official time and optionally at least one other time, by emitting a wireless signal to the remote timer. Such a timekeeping device should include an easy-to-activate triggering device which actuates the wireless signal. Such a timekeeping device also should be utilized in place of a conventional whistle typically used by individuals officiating a game and should be capable of emitting an audible signal when the triggering device is activated. Such a device also should be designed to be comfortably worn by an individual and should not distract the the individual from his officiating duties. Such a timekeeping device and system also should be provided with a two-way communication such that the official time and any other times being displayed on the game clock are also displayed on the portable timekeeping device. Moreover, such a timekeeping device and system should function such that loss of game time is greatly reduced. In addition, such a timekeeping device and system should be capable of being configured easily for use in a variety of sporting events.

SUMMARY OF THE INVENTION

Accordingly, it is an object of the present invention to provide a timekeeping device and system which reduces or eliminates the loss of "game time" typically experienced during a conventional sporting event.

It also is an object of the present invention to provide a timekeeping device and system comprising one or more portable timekeeping devices, each of which being capable of starting, stopping, maintaining and otherwise controlling a remote timer adapted to maintain an official time and optionally, at least one other time, by emitting a wireless signal.

It is an additional object of the present invention to provide a timekeeping device and system comprising one or more portable timekeeping devices, each having an easy-to-use triggering device for actuating a wireless signal.

It is another object of the present invention to provide a timekeeping device and system comprising a portable timekeeping device which is not cumbersome and which can be worn comfortably.

It is a further object of the present invention to provide a timekeeping device and system having two way communication between a remote timer and each portable timekeeping device.

It is yet another object of the present invention to provide a timekeeping device and system in which the official time and any other times displayed on a remote timer are also displayed on each portable timekeeping device being utilized.

It is an additional object of the present invention to provide a timekeeping device and system which is capable of being configured easily for use in a variety of sporting events.

Additional objects, advantages and novel features of the invention will be set forth in part of the description and claims which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein.

DETAILED DESCRIPTION

The present invention relates to a portable timekeeping device which can start, stop, maintain and otherwise control a remote timer which is adapted to maintain an official time or an official time and at least one other time, such as a timekeeping board and/or game clock used in a sporting event. The instant invention also relates to a timekeeping system comprising one or more such portable timekeeping devices and a remote timer adapted to maintain an official time or an official time and at least one other time. In particular, the timekeeping system of the present invention is designed for use with sporting events, including for example, hockey, football and basketball. However, it is to be understood that the inventive timekeeping device and timekeeping system of the present invention can be used in any other application in which it is desired to control a timer from a remote location.

Figure 1:
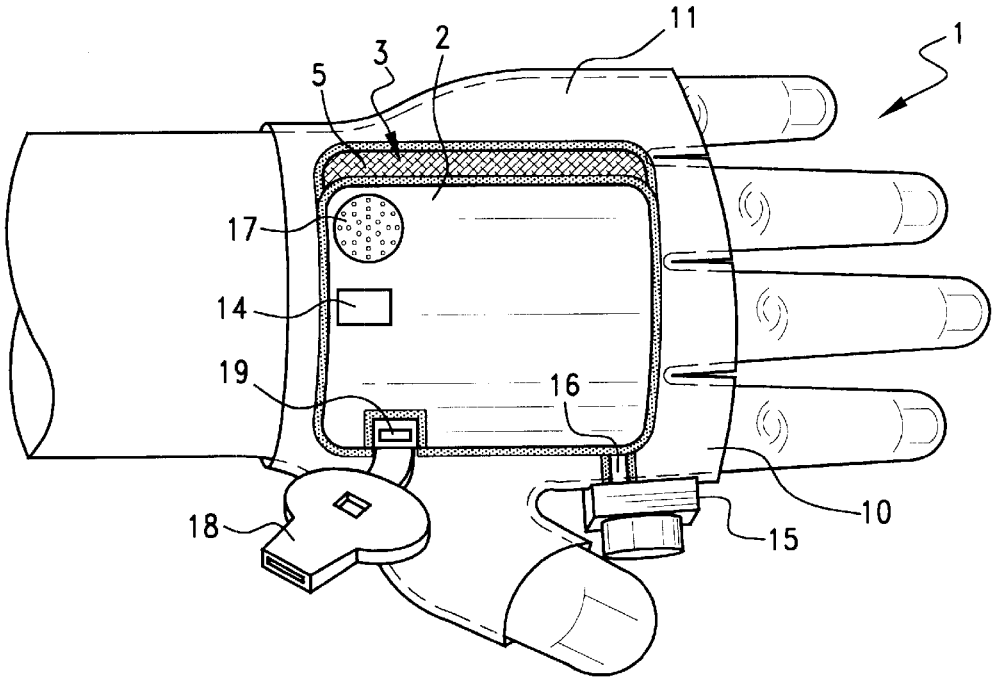
FIG. 1 is a top perspective view of the portable timekeeping device of the present invention.
Figure 2:
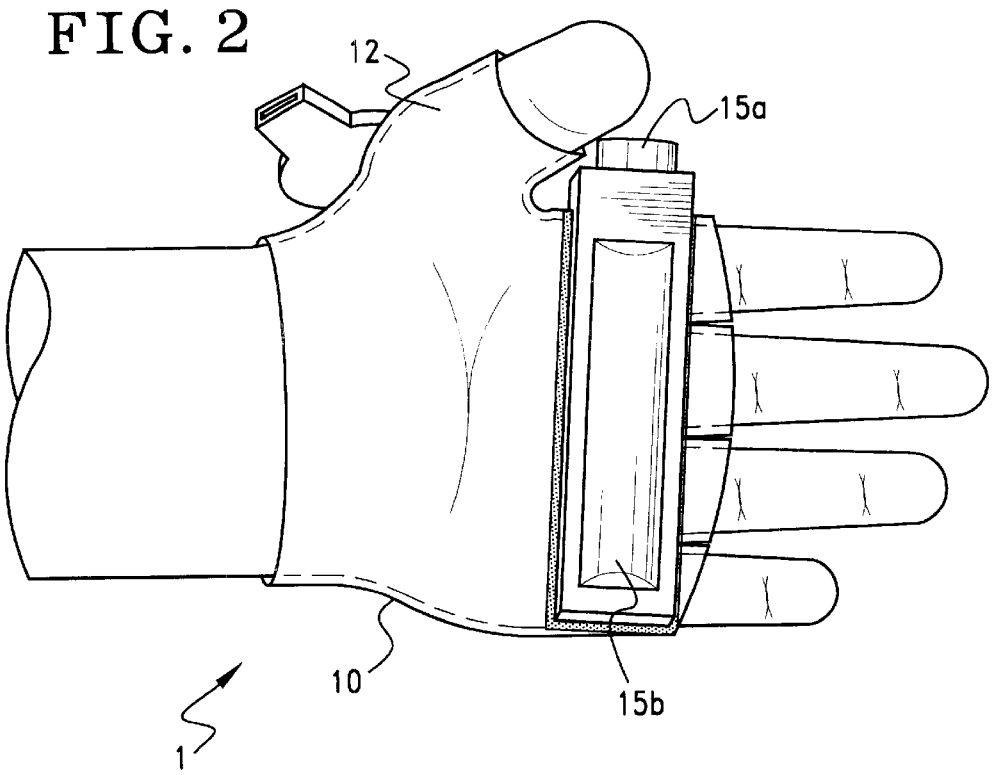
FIG. 2 is a bottom perspective view of the portable timekeeping device of the present invention.

Referring to FIGS. 1 and 2, a portable timekeeping device 1 is shown comprising a portable housing 10 having a top surface 11 and a bottom surface 12, a wireless transmitter 14 disposed within the portable housing 10 and a triggering member 15 disposed within the portable housing for actuating a wireless signal S1 from the wireless transmitter 14. The triggering member 15 can be connected to the wireless transmitter 14 by any suitable means, including for example, a simple wire cable connection 16. Any type of triggering member which can be accessed quickly and easily by an individual for actuating the wireless signal S1 can be utilized in the present invention, including for example, a push button 15*a* disposed within the housing, such as a thumb button, which actuates the wireless signal when depressed or a compressible bar 15*b* which actuates the wireless signal when the bar is squeezed. Preferably, the triggering member 15 of the present invention includes both a push button 15*a* and a compressible bar 15*b*, such that depressing both the push button and squeezing the compressible bar is required to actuate the wireless signal.

The portable housing can be configured in any manner which facilitates handling by an individual. Preferably, the portable housing is adapted to be worn by an individual, suitable examples of which include a hand glove, a wrist watch and a clip-on device, such as a belt clip-on device. More preferably, the portable housing is in the form of a glove. Most preferably, the portable housing is in the form of an open-fingered glove having a pouch 2 stitched to the top surface 11, the pouch having an opening slot 3 for receiving a wireless transmitter box which houses the transmitter 14. Velcro means 5 can be used to detachable secure the opening slot 3 to the pouch 2. When the portable housing is in the form of an open fingered glove, the push button triggering member 15*a* is disposed within the glove such that the push button can be depressed by an individual's thumb, and the compressible bar triggering member 15*b* is disposed on the bottom surface 12 such that the bar can be squeezed when the individual closes his fingers towards his palm, as shown in FIG. 2.

The portable housing 10 (hereinafter sometimes referred to as glove 10), may comprise additional elements to facilitate an individual's ability to officiate a game. For example, an electronic siren/speaker 17 can be disposed within the top surface 11 of the glove for emitting an audible signal when the wireless signal is actuated from the transmitter 14 by the triggering member 15. In addition, an actual whistle member 18 can be mounted within the glove which can be used in conjunction with electronic siren/speaker or can be used by the official when the triggering member 15 fails to actuate a wireless signal for transmission. The whistle member 18 may also include an inner diaphragm 19 such that when the whistle is blown, air enters the diaphragm chamber which actuates the wireless signal in the same manner as the triggering member 15

Figure 3:
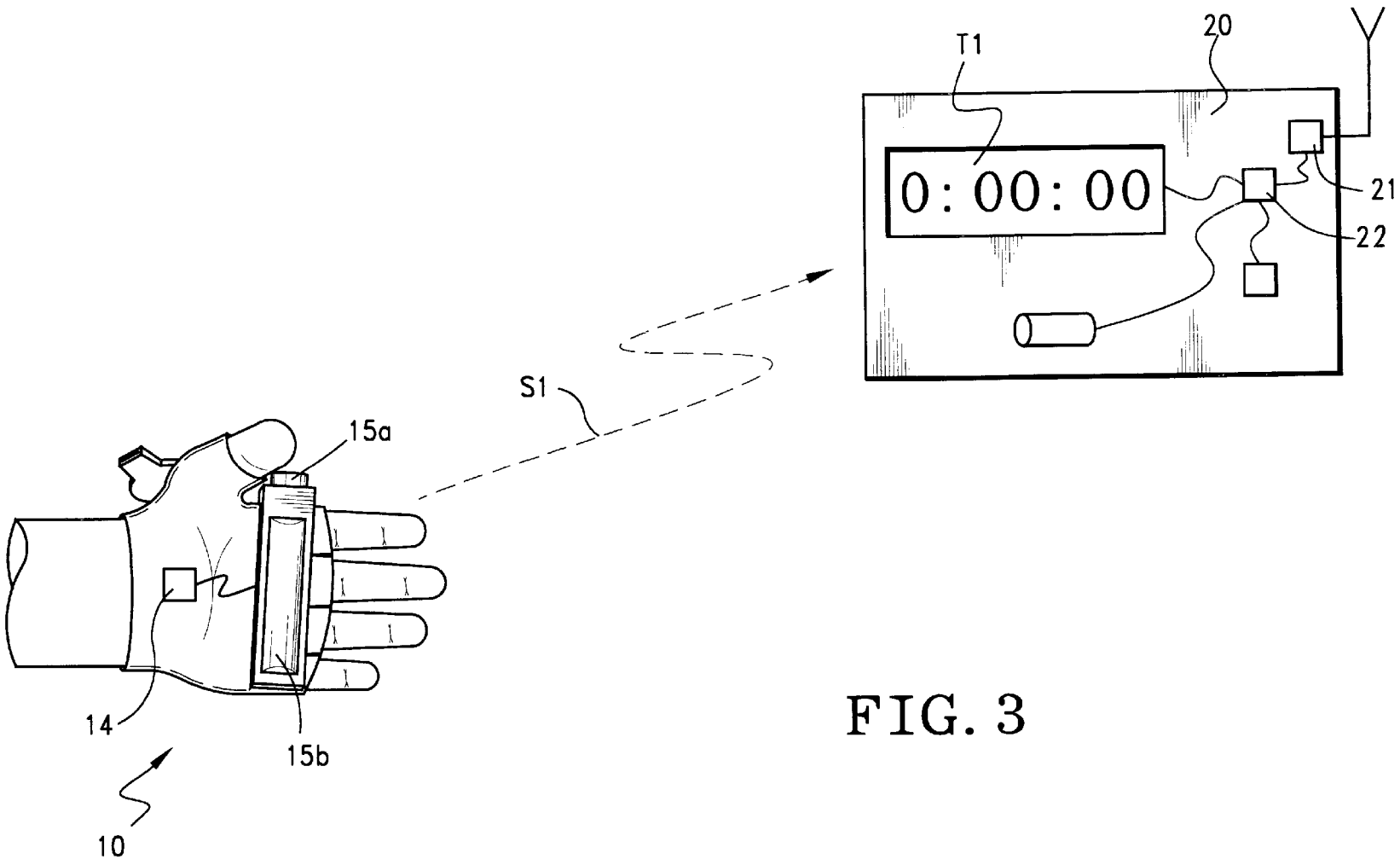
FIG. 3 is a schematic view showing a first timekeeping system using the portable timekeeping device of the present invention.

Upon activation of the triggering member 15, the portable timekeeping device 10 of the present invention actuates and sends a wireless signal S1 from the wireless transmitter 14 to a remote timer 20, as shown in FIG. 3. The remote timer, such as a typical timekeeping board and/or game clock, is adapted to maintain an official time T1 and at least one other time. The wireless signal S1 sent by the portable timekeeping device, stops the official time being maintained on the remoter timer 20. The remote timer 20 comprises a wireless receiver 21 which is adapted to receive the wireless signal S1. The wireless receiver 21 is in electronic communication with the remote timer such that the official time T1 is stopped upon receiving the wireless signal. The wireless receiver may be in direct electronic communication with the remote timer or may be in electronic communication with the remote timer through an electronic control element 22 which is configured to stop the official time T1. The control element 22 can be a simple switching device housed within the remoter timer.

In operation, an individual officiating a sporting game can stop the official time on the remote timer 20 (e.g. timekeeping board and/or game clock) simply by activating the triggering member on the portable timekeeping device. The activation of the triggering member 15, either by depressing the push button 15*a*, squeezing the compressible bar 15*b* or a combination thereof depending on the configuration of the triggering member, actuates a wireless signal S1 from the wireless transmitter 14. The signal S1 immediately is transmitted to the wireless receiver 21. Upon receipt of the wireless signal S1, the official time being maintained on the remote timer 20 is stopped. At the same time, activation of the triggering member 15 causes an audible signal to be emitted from the electronic siren/speaker 17, thereby announcing that the individual officiating the game has caused the official time to be stopped. In this manner, loss of game time is eliminated since the official time is stopped as soon as the individual activates the triggering member 15. In the event of an unlikely electronic trigger failure, the individual can blow the actual whistle 18 to indicate that the official time should be stopped.

Figure 4:
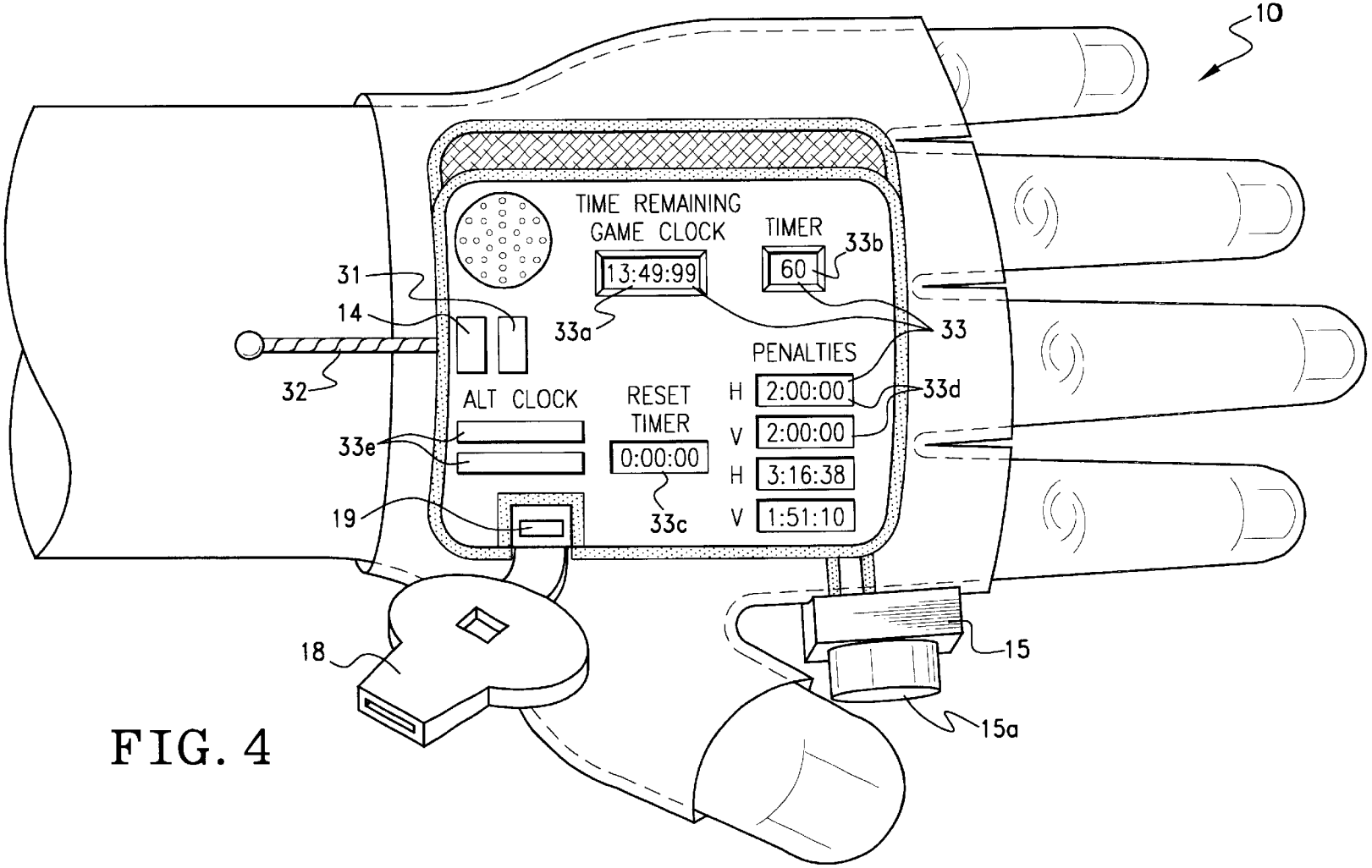
FIG. 4 is a top perspective view of the portable timekeeping device of the present invention which is in two-way communication with a remote timer.

The portable timekeeping device of the present invention also can be configured for two-way wireless communication with a remote timer. Referring to FIG. 4, the portable timekeeping device 1 further comprises a wireless receiver 31, a short, flexible antenna 32 disposed within the portable housing 10 and one or more display windows 33 disposed within the top surface 11 of the portable housing. The one or more display windows 33 preferably are LCD or LED windows and are designed to correspond to the official time T1 and at least one other time maintained on a remote timer (e.g. game clock). Thus, the display windows 33 can include an official time T1 display window 33*a*, and a plurality of other windows, including for example, a time-out display window 33*b*, a reset time display window 33*c*, at least one penalty time display window 33*d* and an alternate timer 33*e* as shown in FIG. 4. However, it is to be understood that number of display windows and the types of time being displayed thereby are not dependent solely upon the time(s) being maintained by a remote timer. Rather the number and type of display windows can be designed for various configurations and to accommodate different sporting events.

Figure 5:
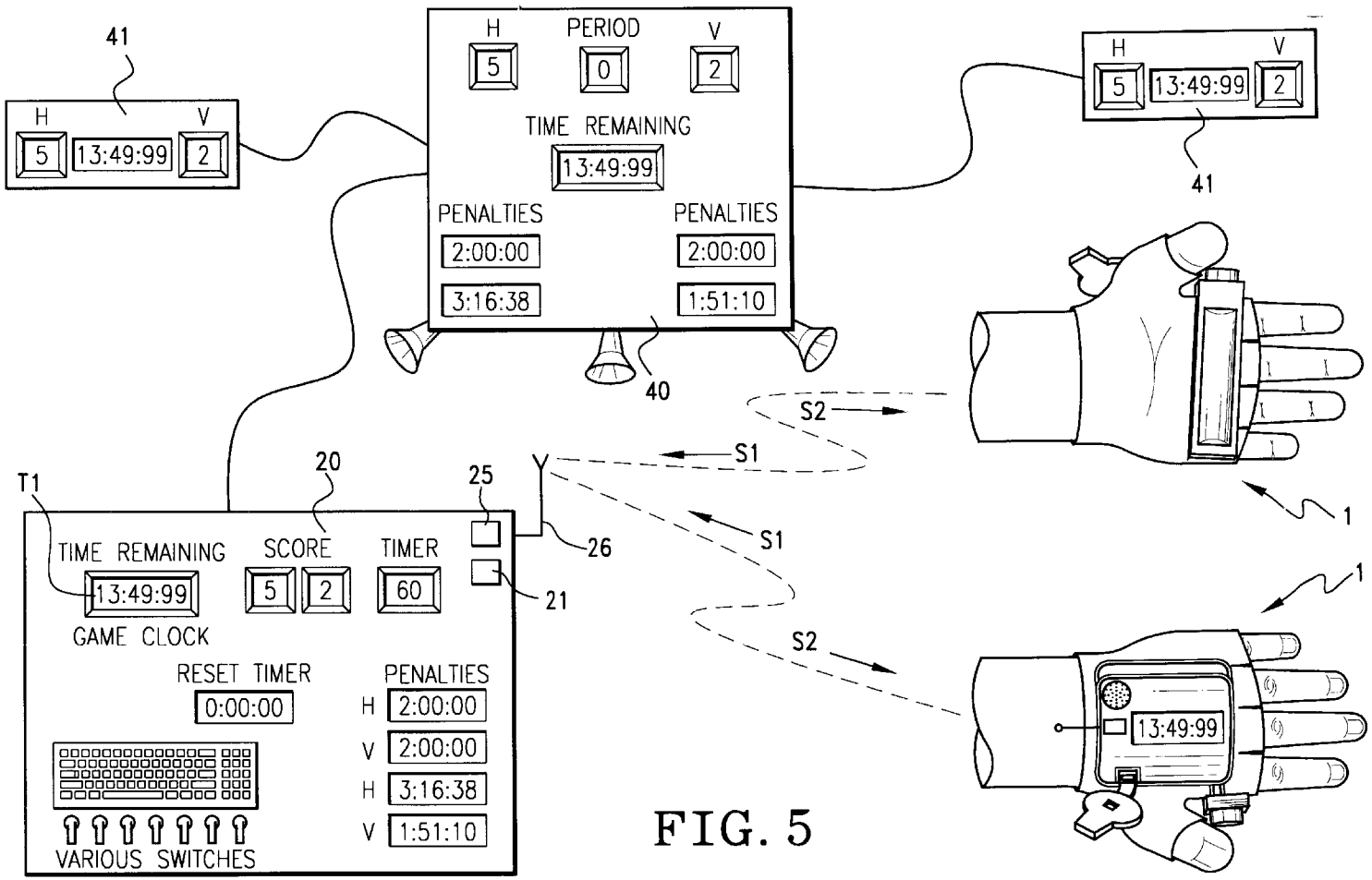
FIG. 5 is a schematic view showing a second timekeeping system using multiple portable timekeeping devices in a sports arena.

As shown in FIG. 5, in order to provide two-way communication between the portable timekeeping device and the remote timer, the remote timer 20 is provided with a wireless transmitter 25 and antenna 26 and continuously transmits a wireless signal S2 which is received by the wireless receiver 31 disposed within the portable housing 10 of each of the portable timekeeping devices 1. In this manner, the timekeeping system of the present invention synchronizes the official time T1 being maintained by the remote timer (as well as any other times being maintained by the remote timer) with the official time being displayed in display window 33*a*. Thus, the time displayed in the official time display window 33*a* is the actual official time T1 being maintained by the remote timer 20. When an individual using the portable timekeeping device activates the triggering member 15, thereby actuating the wireless signal S1 to stop the official time T1 on the remote timer 20, the official time displayed in display window 33*a* also is stopped.

FIG. 5 also shows the timekeeping system of the present invention comprising a plurality of portable timekeeping devices 1, a remote timer 20 in the form of a timekeeping board which also is in time with the arena clocks 41 on the scoreboards by conventional hard wire. In addition, the center arena clock 40 can be fitted with small electronic whistle sirens that can emit audible signals precisely when the audible signal from the portable timekeeping device is emitted.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A timekeeping device for controlling a remote timer adapted to maintain an official time, said timekeeping device comprising:

(a) a portable housing having a top surface and a bottom surface, said portable housing being in the form of a glove;

(b) a wireless transmitter disposed within said portable housing;

(c) a triggering member disposed within said portable housing for actuating a wireless signal from said wireless transmitter, and (d) an electronic siren and speaker element disposed within said portable housing, said electronic siren and speaker element being actuated by activation of said triggering member to emit an audible signal, wherein, activation of said triggering member actuates a wireless signal which is transmitted from said wireless transmitter to a remote timer in such a manner that the official time maintained on said remote timer is stopped.

2. The timekeeping device in accordance with claim 1, wherein said remote timer comprises a wireless receiver adapted to receive said wireless signal from said wireless transmitter.

3. The timekeeping device in accordance with claim 2, wherein said remote timer further comprises a control element in electronic communication with said wireless receiver and said remote timer, said control element adapted to stop said official time when said wireless signal is received by said wireless receiver.

4. The timekeeping device in accordance with claim 1, wherein said triggering member is in the form of a push button such that depressing said push button activates said triggering member.

5. The timekeeping device in accordance with claim 1, wherein said triggering member is in the form of a compressible bar such that compressing said bar activates said triggering member.

6. The timekeeping device in accordance with claim 1, wherein said triggering member comprises the combination of a push button and a compressible bar such that depressing said push button and compressing said compressible bar activates said triggering member.

7. The timekeeping device in accordance with claim 1, further comprising a whistle disposed within said portable housing, said whistle having an internal diaphragm trip switch.

8. The timekeeping device in accordance with claim 1, wherein said portable housing further comprises a pouch element secured to said top surface, said pouch element having an opening adapted to receive said wireless transmitter.

9. The timekeeping device in accordance with claim 8, wherein said wherein said triggering member is in the form of a push button disposed within said portable housing in such a manner that depressing said push button activates said triggering member.

10. The timekeeping device in accordance with claim 8, wherein said triggering member is in the form of a compressible bar disposed within said bottom surface of said portable housing in such a manner that squeezing said compressible bar activates said triggering member.

11. The timekeeping device in accordance with claim 8, wherein said triggering member comprises the combination of a push button and a compressible bar such that depressing said push button and squeezing said compressible bar activates said triggering member.

12. A timekeeping system comprising:

(a) a remote housing having a remote timer adapted to maintain an official time;

(b) a control element in electronic communication with said remote timer, said control element adapted to start and stop said official time;

(c) a remote wireless receiver disposed with said remote housing, said remote wireless receiver in electronic communication with said control element;

(d) a remote wireless transmitter disposed within said remote housing, said remote wireless transmitter adapted to transmit said official time to a portable wireless receiver;

(e) a portable timekeeping device having a top surface and a bottom surface;

(f) a portable wireless transmitter disposed within said portable timekeeping device, said portable wireless transmitter adapted to transmit a wireless signal to said remote wireless receiver;

(g) a triggering member disposed within said portable timekeeping device for actuating a wireless signal from said portable wireless transmitter, and (h) a portable wireless receiver disposed within said portable timekeeping device, said portable wireless receiver adapted to receive said official time from said portable wireless transmitter, wherein, activation of said triggering member actuates a wireless signal from said portable wireless transmitter to said remote wireless receiver in such a manner that said control element stops said official time.

13. The timekeeping system in accordance with claim 12, wherein said remote timer is adapted to maintain at least one other time, said control element is adapted to start and stop said at least one other time, said remote wireless transmitter is adapted to transmit said at least one other time and said portable wireless receiver is adapted to receive said at least one other time.

14. The timekeeping device in accordance with claim 12, further comprising an electronic siren and speaker element disposed within said portable device, said electronic siren and speaker element being actuated by activation of said triggering member to emit an audible signal.

15. The timekeeping system in accordance with claim 12, wherein said triggering member is in the form of a push button such that depressing said push button activates said triggering member.

16. The timekeeping system in accordance with claim 12, wherein said triggering member is in the form of a compressible bar such that compressing said bar activates said triggering member.

17. The timekeeping system in accordance with claim 12, wherein said triggering member comprises the combination of a push button and a compressible bar such that depressing said push button and compressing said compressible bar activates said triggering member.

18. The timekeeping system in accordance with claim 12, further comprising a whistle disposed within said portable device, said whistle having an internal diaphragm switch.

19. The timekeeping system in accordance with claim 12, wherein said portable timekeeping device is in the form of a glove having a pouch element secured to said top surface, said pouch element having an opening adapted to receive said portable wireless transmitter and said wireless receiver.

20. The timekeeping system in accordance with claim 19, wherein said triggering member is in the form of a push button disposed within said portable housing in such a manner that depressing said push button activates said triggering member.

21. The timekeeping system in accordance with claim 19, wherein said triggering member is in the form of a compressible bar disposed within said bottom surface of said portable housing in such a manner that squeezing said compressible bar activates said triggering member.

22. The timekeeping system in accordance with claim 19, wherein said triggering member comprises the combination of a push button and a compressible bar such that depressing said push button and squeezing said compressible bar activates said triggering member.

23. The timekeeping system in accordance with claim 12, wherein said portable device further comprises a first display window for displaying said official time.

24. The timekeeping system in accordance with claim 13, wherein said portable device further comprises a first display window for displaying said official time and at least one other display window for display said at least one other time.

25. The timekeeping system in accordance with claim 13, wherein said at least one other time is a plurality of other times.

26. The timekeeping system in accordance with claim 25, wherein said portable device comprises a first display window for displaying said official time and a plurality of other display windows, each of said plurality of display windows adapted to display one of said other plurality of times.

27. The timekeeping system in accordance with claim 26, wherein said plurality of other times include a penalty time, a time-out time, a re-set time, and an alternate time.

28. The timekeeping system in accordance with claim 12, comprising a plurality of portable timekeeping devices, each of said portable timekeeping devices comprising:

(a) a top surface and a bottom surface;

(b) a portable wireless transmitter disposed within said portable timekeeping device, said portable wireless transmitter adapted to transmit a wireless signal to said remote wireless receiver;

(c) a triggering member disposed within said portable timekeeping device for actuating a wireless signal from said portable wireless transmitter, and (d) a portable wireless receiver disposed within said portable timekeeping device, said portable wireless receiver adapted to receive said official time.

* * * * *